US005848917A

United States Patent [19]

Bechaz et al.

[11] Patent Number: 5,848,917

[45] Date of Patent: Dec. 15, 1998

[54] INTERCONNECTION ASSEMBLY OF ELECTRICAL EQUIPMENT, IN PARTICULAR FOR JUNCTION BLOCK TYPE EQUIPMENT, AND A HOUSING FITTED WITH SUCH AN ASSEMBLY

[75] Inventors: Bernard Bechaz, Calluire; André Imperato, Qullins, both of France

[73] Assignee: Entrelec S.A., Villeurbanne, France

[21] Appl. No.: 780,541

[22] Filed: Jan. 9, 1997

[51] Int. Cl.[6] ..... H01R 9/26

[52] U.S. Cl. ..... 439/716

[58] Field of Search ..... 439/716, 717, 439/715, 532, 856, 857

[56] References Cited

U.S. PATENT DOCUMENTS 5,314,350 5/1994 Matthews et al. ..... 439/717

FOREIGN PATENT DOCUMENTS

0388058A1 9/1990 European Pat. Off. .

2513437 3/1983 France .

2708385A1 2/1995 France .

1068233 5/1967 United Kingdom .

1240984 7/1971 United Kingdom .

2155252 9/1985 United Kingdom .

*Primary Examiner*—Khiem Nguyen

*Assistant Examiner*—Eugene G. Byrd

*Attorney, Agent, or Firm*—Sughrue, Mion, Zinn, Macpeak & Seas, PLLC

[57] ABSTRACT

An interconnection assembly for electrical equipment, including connection terminals for electrical conductors disposed in staged manner on different sides of a housing and electrically and selectively interconnected by conductive link strips disposed at least in part at different stage levels within the housing. It comprises at least two fixed strips to be interconnected, each including at least one projection facing a corresponding projection disposed on the other strip, and at least one conductive interconnection part, preferably of the rod or blade type, having ends each forming a respective clamp enabling it to be engaged on the facing projections of the strips to be interconnected.

7 Claims, 4 Drawing Sheets

INTERCONNECTION ASSEMBLY OF ELECTRICAL EQUIPMENT, IN PARTICULAR FOR JUNCTION BLOCK TYPE EQUIPMENT, AND A HOUSING FITTED WITH SUCH AN ASSEMBLY

The invention relates to an interconnection assembly of link strips between terminals for electrical equipment, and in particular electrical junction block type equipment. It also relates to equipment housings fitted with such an assembly.

BACKGROUND OF THE INVENTION

Numerous types of electrical equipment include connection terminals designed to receive electrical conductors and selectively interconnected by means of conductive link strips.

Such assemblies are provided in particular in equipment of the electrical junction block type where the terminals and the strips are housed and fixed within containers made of molded insulating material and having openings giving access to the terminals from outside the containers.

In some equipment, and in particular in some junction blocks, the connection terminals are disposed in staged manner on opposite sides, e.g. on two opposite sides of a housing serving as a container. Link strips interconnect terminals disposed on opposite sides of the housing, e.g. terminals situated at a common level.

It is sometimes necessary to provide electrical interconnections between strips that are disposed at different levels, with this being done, for example, in zones where the strips are themselves parallel. Conductive parts are then provided that are fixed between the strips to be interconnected, e.g. by soldering or screw assembly.

Such solutions are not always very appropriate, particularly when the interconnections need to be made not at the time when the junction blocks are assembled, but at a later time, e.g. on the site where they are used.

OBJECTS AND SUMMARY OF THE INVENTION

The invention thus provides an interconnection assembly of link strips between terminals for electrical equipment, in particular electrical junction block type equipment including connection terminals for electrical conductors disposed in staged manner on different sides of a housing and electrically and selectively interconnected by conductive link strips disposed at least in part at different stage levels within the housing.

According to a characteristic of the invention, the assembly comprises at least two fixed strips to be interconnected, each including at least one projection facing a corresponding projection disposed on the other strip, and at least one conductive interconnection part, preferably of the rod or blade type, having ends each forming a respective clamp enabling it to be engaged on the facing projections of the strips to be interconnected.

According to another characteristic of the invention, the interconnection part includes clamp ends having respective openings disposed laterally and both opening in the same direction so as to be placed astride the facing projections of the strips they interconnect from the same side.

According to another characteristic of the invention, the interconnection part includes clamp ends having respective openings directed laterally and facing in two opposite directions.

The invention also provides a housing for electrical equipment, in particular of the junction block type, including connection terminals for electrical conductors disposed in staged manner on different sides of a housing and electrically and selectively interconnected by conductive link strips disposed at least in part at different stage levels within the housing.

According to a characteristic of the invention, the housing includes at least one interconnection assembly as characterized above.

BRIEF DESCRIPTION OF THE DRAWINGS

The invention, its characteristics, and advantages are described in greater detail below with reference to the accompanying figures.

MORE DETAILED DESCRIPTION

Figure 1:
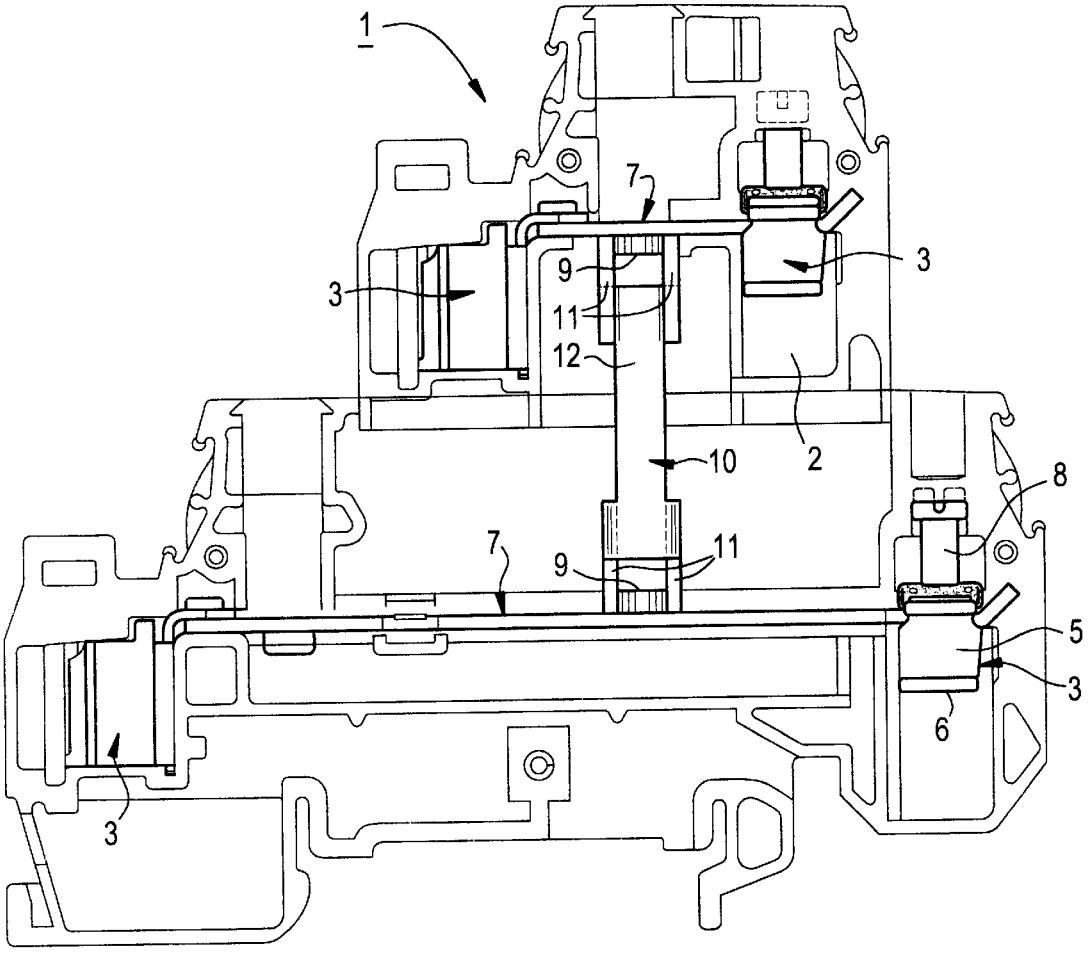
FIGS. 1 and 2 are two different views of the same electrical junction block housing including an interconnection assembly of the invention, shown in elevation and in perspective.
Figure 2:
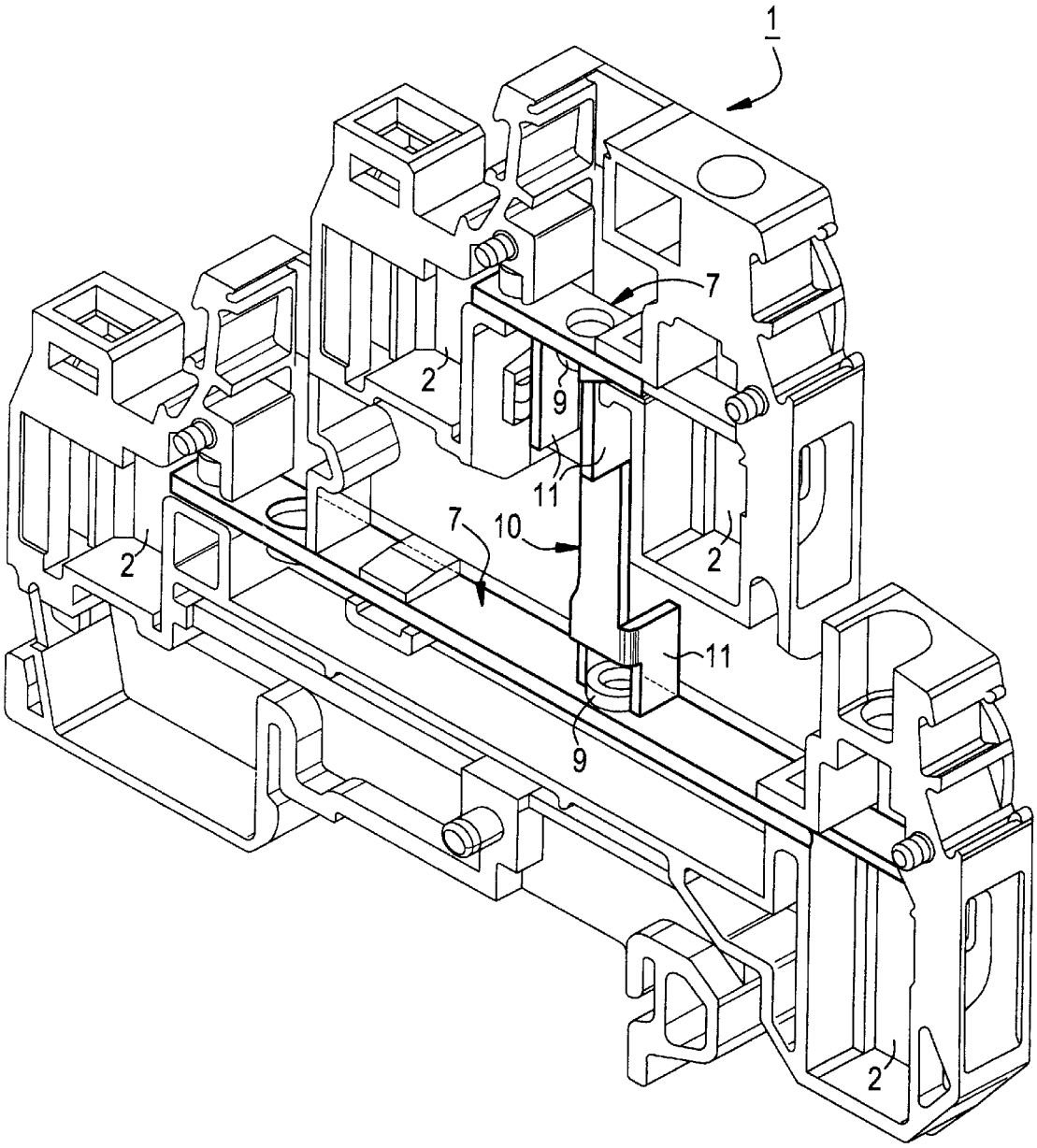

The electrical junction block shown by way of example in FIGS. 1 and 2 conventionally comprises a housing 1 that is generally molded out of insulating material, and which may, for example, be of a type similar to that described in French patent 2 708 385 or French patent 2 513 437. The housing 1 has compartments 2 suitable for receiving electrical connection terminals 3 for conductors that are external to the housing. The terminals are shown as being located in two stage levels and on two opposite sides of the housing 1, and they are assumed to be screw-type terminals each comprising a loop 5 suitable for receiving an electrical conductor, comprising a single strand wire or a multistrand wire which is held between a clamping jaw 6 of the loop and an end portion of a strip 7 which passes through the loop, as can be seen most clearly for the lower right terminal in FIG. 1.

A compartment 2 is provided for each terminal 3, each compartment having an opening to the outside to the housing 1 suitable for admitting a conductor to be connected to a terminal between the loop of the terminal and the strip on which the loop is placed. In the embodiment shown, the respective loops of the terminals are free to move in translation relative to the strips on which they are placed in the compartments provided for the terminals. The loops are moved by drive screws 8 associated therewith and bearing against the strips, in a well-known configuration.

The strips 7 shown herein are made of an appropriately conductive metal and they are each designed to interconnect at least two terminals. In the variant shown in FIGS. 1 to 3, each of the two strips shown is assumed to be fixed and connected to two terminals disposed on two respective opposite sides of a housing and at practically the same level relative to the support base of the housing shown herein.

The two strips are shown as being disposed one above the other in a housing which is narrow compared with its other dimensions, as can be seen clearly in FIG. 1.

In some applications, there can be a need to interconnect two adjacent strips, e.g. strips in respective positions of the kind mentioned above. Nevertheless, to implement the assembly of the invention it is necessary only that the strips to be interconnected include facing portions capable of being connected together by a conductive interconnection part. In the present invention, this part is preferably rigid and generally rectilinear, such as a rod or a blade, occupying a volume that is left empty in the housing between said two portions, as can easily be envisaged with reference to FIG. 1 of French patent 2 513 437.

A projection 9 is made on the two portions facing each other on respective strips 7 to enable an interconnection part 10 to be positioned between the two strips 7 in question. Each projection 9 is cylindrical in appearance, for example, being obtained by mechanically deforming or locally cutting out the strip in the zone concerned. The interconnection part 10 is shaped in this case to be suitable for co-operating with the two superposed projections facing each other on the two strips to be interconnected. To this end, in the embodiment shown, a clamp 11 is formed at each of the two opposite connection ends of the interconnection part, these clamps being of dimensions that enable each of them to be fixed on a respective one of the facing projections on the two strips concerned.

Figure 3:
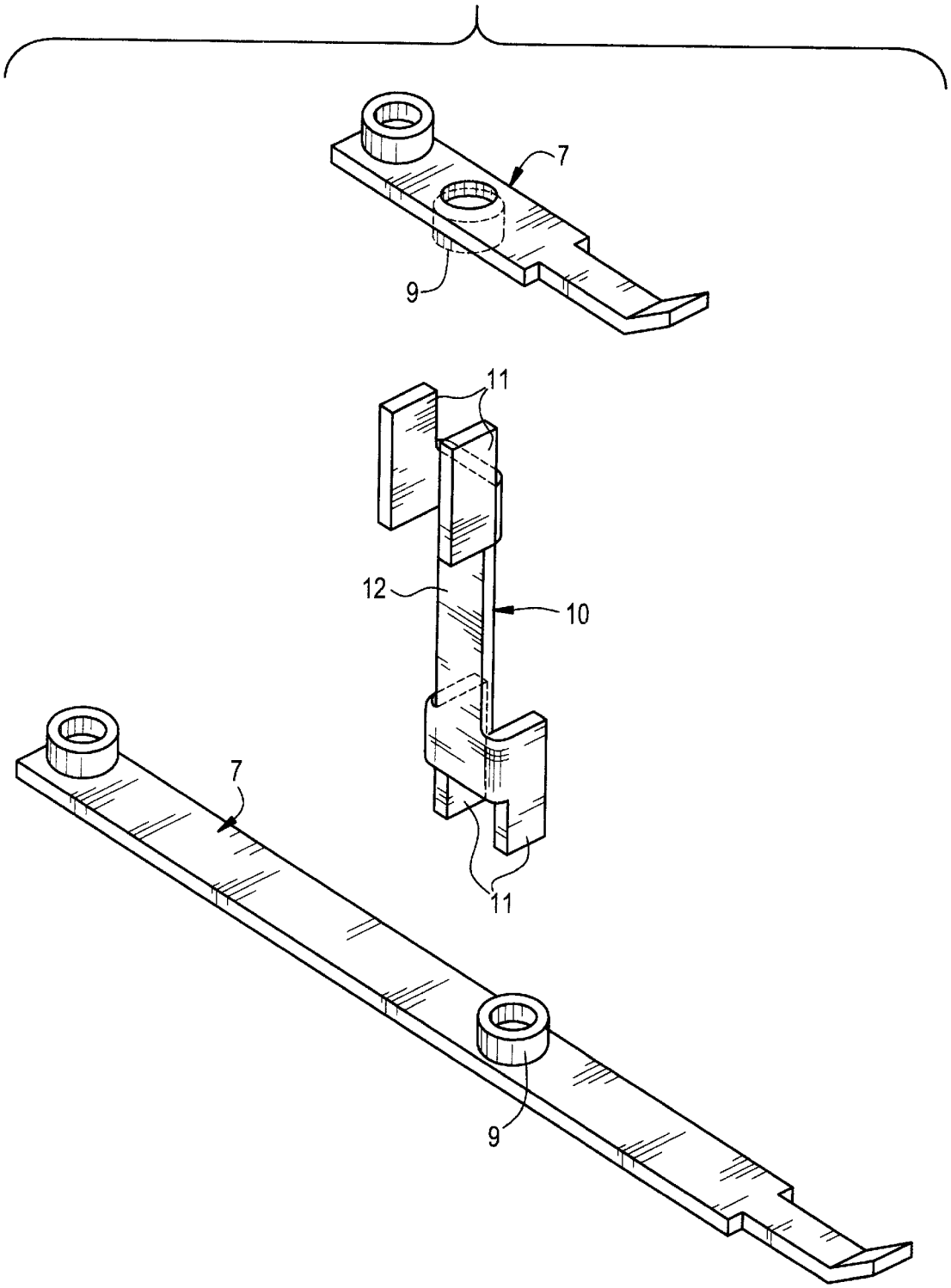
FIG. 3 is an exploded view of an interconnection assembly of the invention.

In the example shown in FIG. 3, each clamp 11 has two plane parallel portions extending perpendicularly from a common third portion 12 and spaced apart from each other by a gap that corresponds to the diameter of a projection in the zone of said projection that is to cooperate with an end clamp.

In a first variant embodiment (not shown) both of the clamps 11 of an interconnection part are formed on the same side of the part and open in the same direction so that both of them are placed astride the facing projections 9 of the strips they interconnect from the same side. The interconnection part preferably bears against at least one of the two strip walls carrying the two facing projections, and also against a back wall of the housing 11 via the edges of both clamps.

In a second embodiment as shown in FIG. 3, the two clamps 11 of an interconnection part 10 are formed on opposite sides of said part, and thus open in diametrically opposite directions. The interconnection part bears against at least one of the two walls carrying the two facing projections on respective strips, and also against the back of the housing 1 via the edges of one of its two clamps, the edges of the other clamp being suitable for engaging the wall (not shown) of a cover or another housing that closes the open face of the housing remote from its back.

As mentioned above, FIG. 4 shows a fragmentary view of a housing 1' of the junction block that includes a variant interconnection assembly of the invention.

This housing 1' has compartments such as 2' suitable for receiving electrical terminals 3' for engaging conductors external to the housing. In this case, the terminals are assumed to be of the same type as the terminals 3 described above and each of them co-operates with a strip 7' that is functionally identical to a strip 7, and the strips 7' that are to be interconnected include respective projections 9' and 9" intended to cooperate with an interconnection part 10'.

Figure 6:
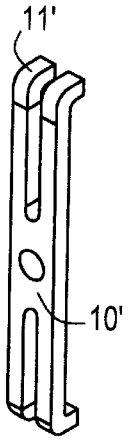
FIG. 6 is a perspective view of the interconnection part in the variant shown in FIGS. 4 and 5.

As can be seen more clearly in FIG. 6, the interconnection part 10' is constituted by a metal blade that is initially in the form of an elongate rectangle having two longitudinally split ends both folded in the same direction, substantially through a right angle.

Figure 4:
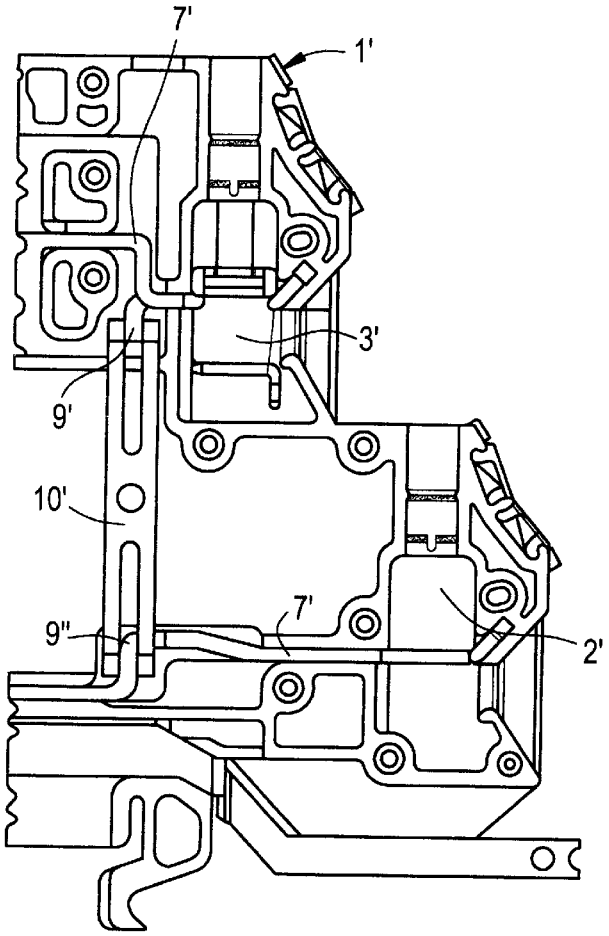
FIG. 4 is a fragmentary elevation view of a variant junction block housing including an interconnection assembly of the invention.
Figure 5:
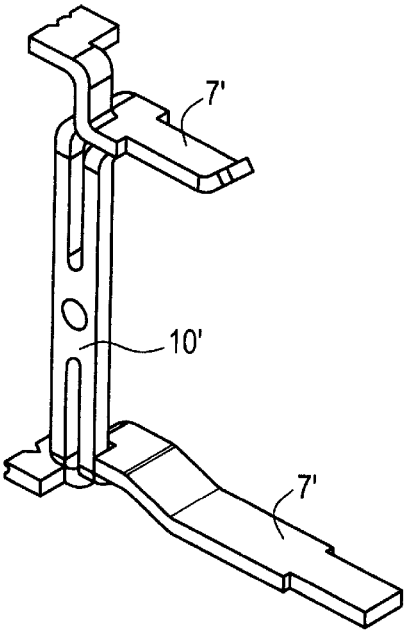
FIG. 5 is a fragmentary perspective view of the assembly shown in FIG. 4.

These ends thus constitute clamps 11' extending laterally and opening in the same direction so as to be placed astride the corresponding projections from the same side, which projections are in alignment and extend towards each other from the two strips 7' to be interconnected, as shown in FIGS. 4 and 5.

The, or each, projection formed on the strips can be in the form of a genuinely projecting portion such as 9' obtained by cutting out and folding, or else it can be in the form of a portion of the strip that extends in the same direction as the projection on the other strip, said portion preferably extending between bends in the strip concerned, such as the portion 9". By positioning a portion such as 9' between two bends of a strip, one of the clamps 11' of an interconnection part 10 is bracketed so as to prevent said interconnection part sliding longitudinally relative to the strip, thereby holding said part in its interconnection position. Naturally, this function of preventing lateral sliding could be performed by providing a set of two bends in each of the strips to constitute the projection of said strip, or it could be provided by one only of the strips, or it could be provided by internal relief within the housing.

With both of the embodiments shown and with housings of the kind shown in FIGS. 1, 2, and 3, i.e. housings having an open face as described above, it is possible, prior to the housing being put into place, for an installer to place an interconnection part 10 or 10' therein where so required without disassembling any other part and without having to use a special tool.

Alternatively, the housings may be delivered to installers with such an interconnection part already fitted, leaving it to installers to remove manually any interconnection parts that are not required.

The clamping effect exerted by an interconnection part on the projections that it engages is preferably designed to be such as to enable said part to keep itself in position between the strips that it interconnects.

We claim:

1. An interconnection assembly of link strips between terminals for electrical equipment, in particular electrical junction block type equipment including connection terminals for electrical conductors disposed in staged manner on different sides of a housing and electrically and selectively interconnected by conductive link strips disposed at least in part at different stage levels within the housing, the assembly comprising at least two fixed link strips to be interconnected, each including at least one projection facing a corresponding projection disposed on the other strip, and at least one conductive interconnection part, of a rod or blade type, having ends each forming a respective clamp enabling it to be engaged on the facing projections of the strips to be interconnected.

2. An assembly according to claim 1, wherein the interconnection part includes clamp ends having respective openings disposed laterally and both opening in the same direction so as to be placed astride the facing projections of the strips they interconnect from the same side.

3. An assembly according to claim 1, wherein the interconnection part includes clamp ends having respective openings directed laterally and facing in two opposite directions.

4. A housing for electrical equipment, in particular of the junction block type, including connection terminals for electrical conductors disposed in staged manner on different sides of a housing and electrically and selectively interconnected by conductive link strips disposed at least in part at different levels within the housing, the housing including at least one interconnection assembly according to claim 1.

5. An assembly according to claim 1, wherein each clamp is arranged to laterally slidably engage one of said projections.

6. An assembly according to claim 1, wherein each clamp includes two plane parallel portions extending perpendicularly from a common third portion.

7. An assembly according to claim 6, wherein each of said projections is cylindrical and includes a diameter, and said two plane parallel portions are spaced apart from each other so as to form a gap corresponding to the diameter of each projection.

* * * * *